US007788753B2

(12) United States Patent
Park

(10) Patent No.: US 7,788,753 B2
(45) Date of Patent: Sep. 7, 2010

(54) LAUNDRY MACHINE AND A METHOD FOR OPERATING THE SAME

(75) Inventor: Seog Kyu Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/791,120

(22) PCT Filed: May 24, 2006

(86) PCT No.: PCT/KR2006/001959

§ 371 (c)(1),
(2), (4) Date: Aug. 8, 2008

(87) PCT Pub. No.: WO2007/024057

PCT Pub. Date: Mar. 1, 2007

(65) Prior Publication Data

US 2008/0302142 A1 Dec. 11, 2008

(30) Foreign Application Priority Data

Aug. 25, 2005 (KR) ..... 10-2005-0078195

(51) Int. Cl.
*D06F 33/00* (2006.01)
*D06F 39/00* (2006.01)

(52) U.S. Cl. ..... 8/149.3; 8/158

(58) Field of Classification Search ..... 68/5 C, 68/5 R, 12.05; 8/149, 149.1, 149.2, 149.3, 8/158, 159
See application file for complete search history.

(56) References Cited

U.S. PATENT DOCUMENTS

2004/0244432 A1* 12/2004 Kim et al. ..... 68/5 C
2005/0034489 A1* 2/2005 Oh et al. ..... 68/5 C

FOREIGN PATENT DOCUMENTS

EP 1544345 A2 6/2005
EP 1550760 A2 7/2005

* cited by examiner

*Primary Examiner*—Joseph L Perrin
*Assistant Examiner*—Benjamin Osterhout
(74) *Attorney, Agent, or Firm*—McKenna Long & Aldridge LLP

(57) ABSTRACT

Disclosed are a structure of a washing machine having a steam generator (400), which drains remaining steam water, and a method for controlling the same. The washing machine includes a steam generator (400) including a case forming a space for storing water to generate steam, and a drain pipe (450) connected to the case (410) for draining the stored water; a valve (451) installed on the drain pipe (450); and a controller for controlling the steam generator and the drain opening/closing part valve.

11 Claims, 7 Drawing Sheets

[Fig. 1]
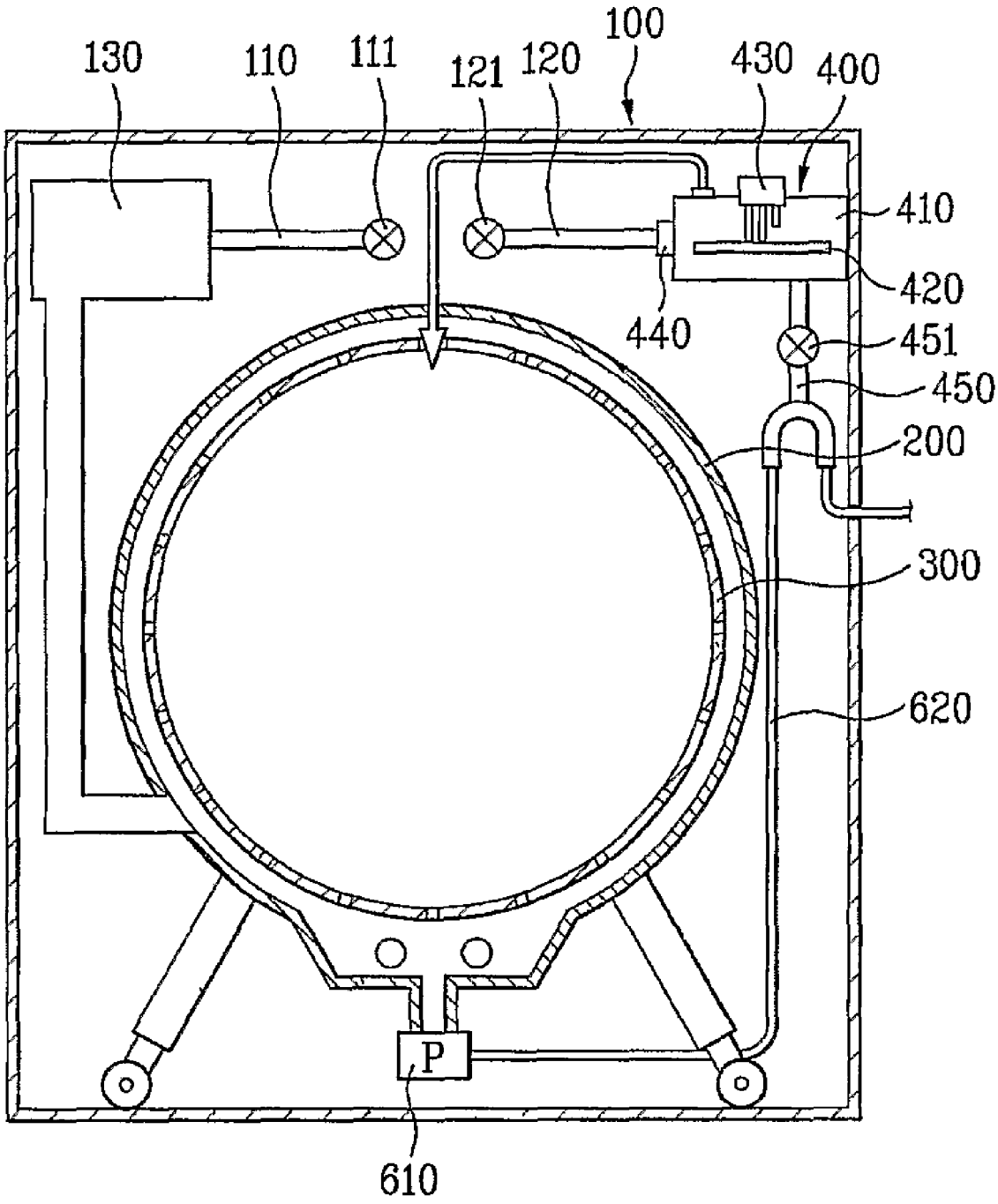

[Fig. 2]
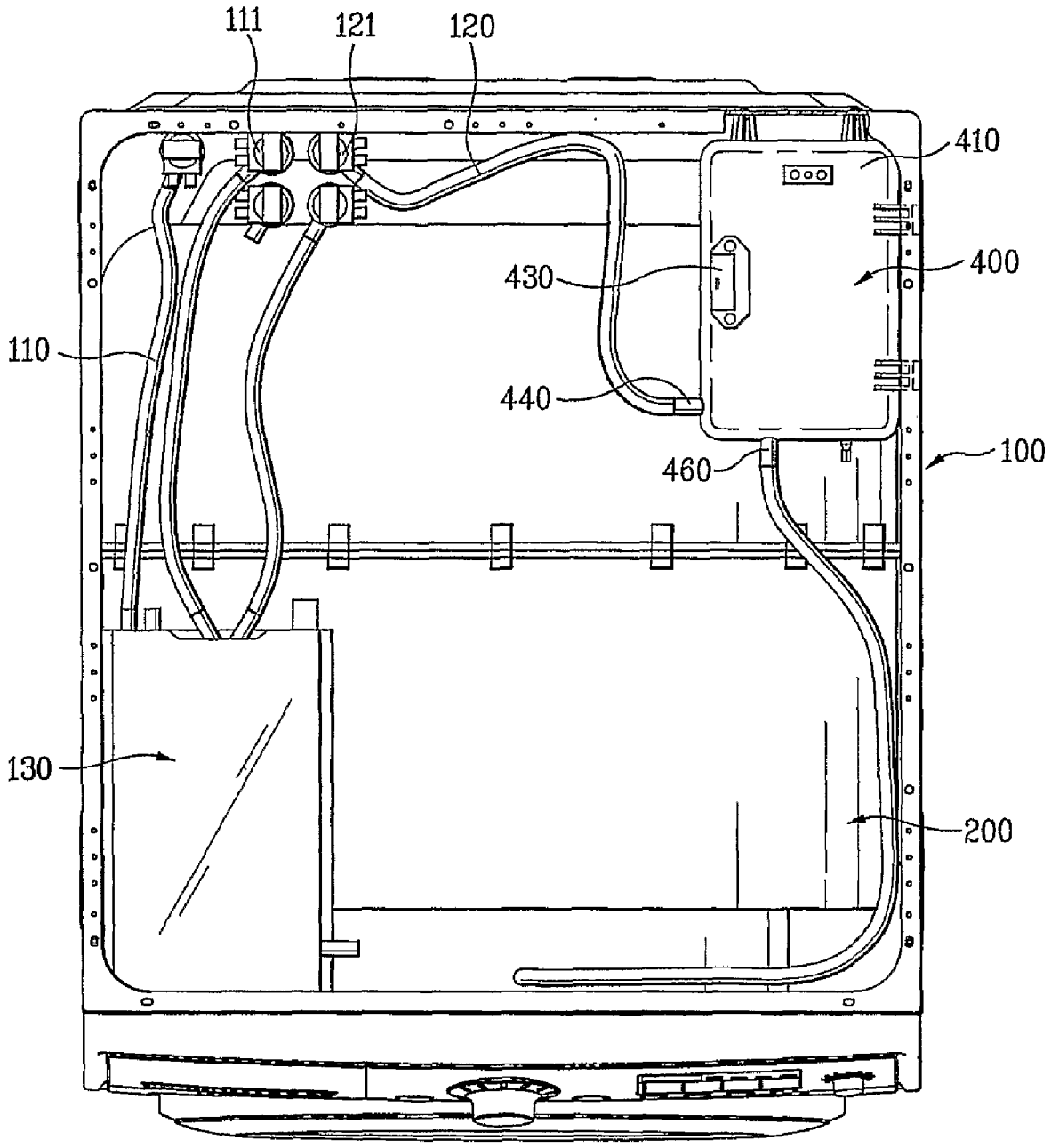

[Fig. 3]
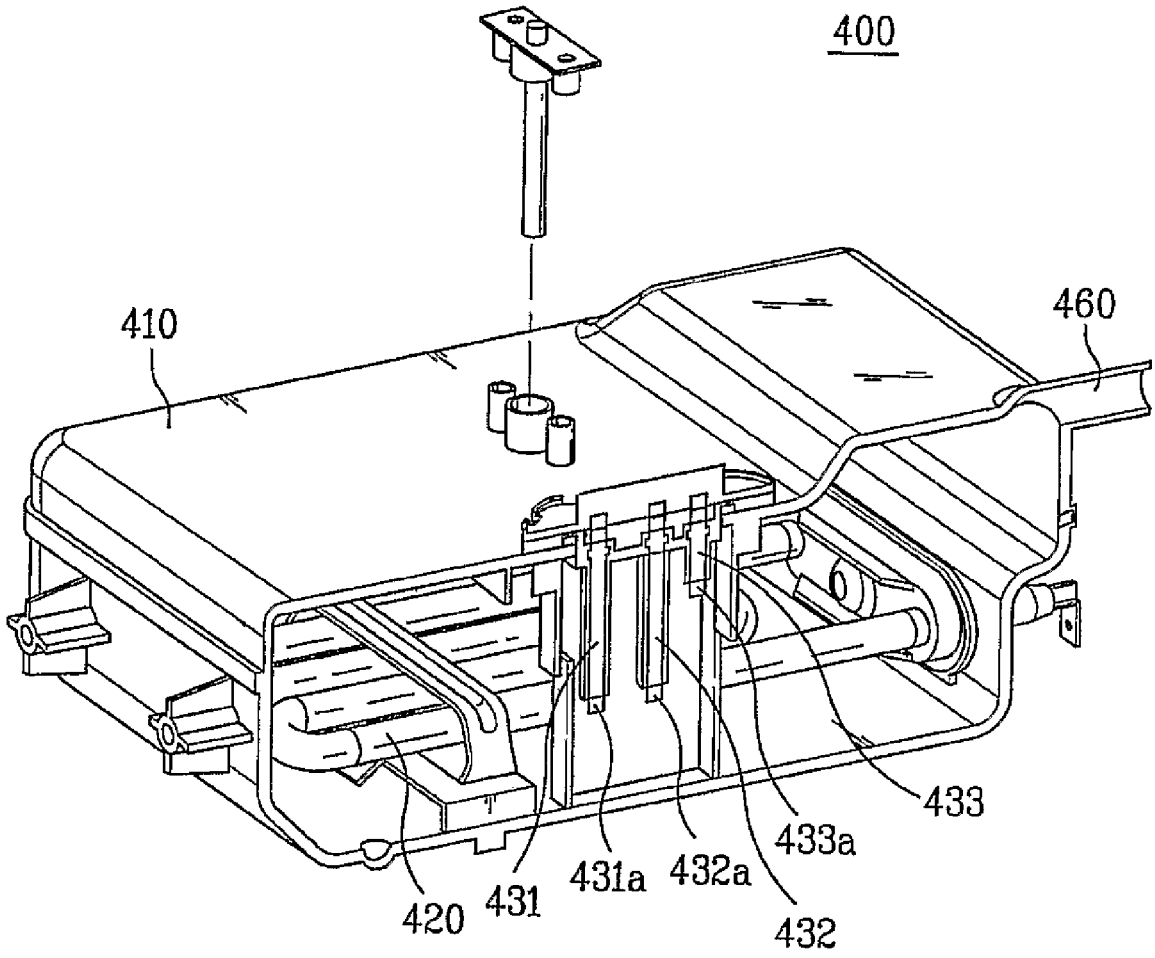

[Fig. 4]
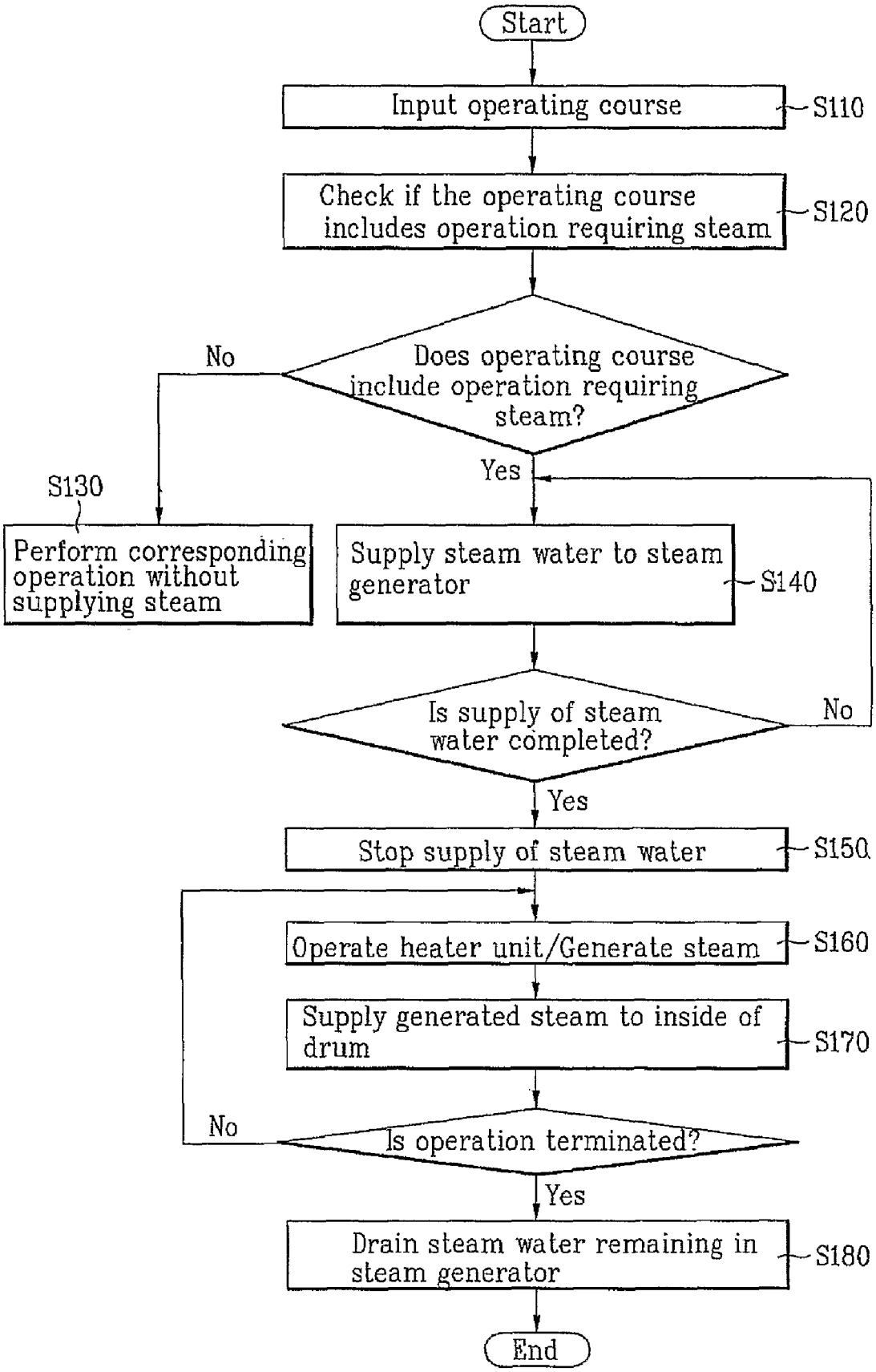

[Fig. 5]
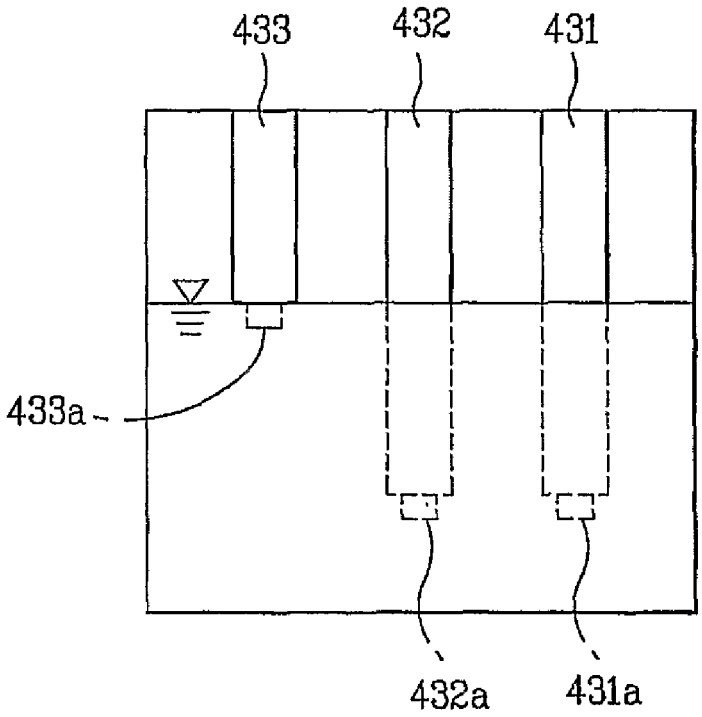
[Fig. 6]
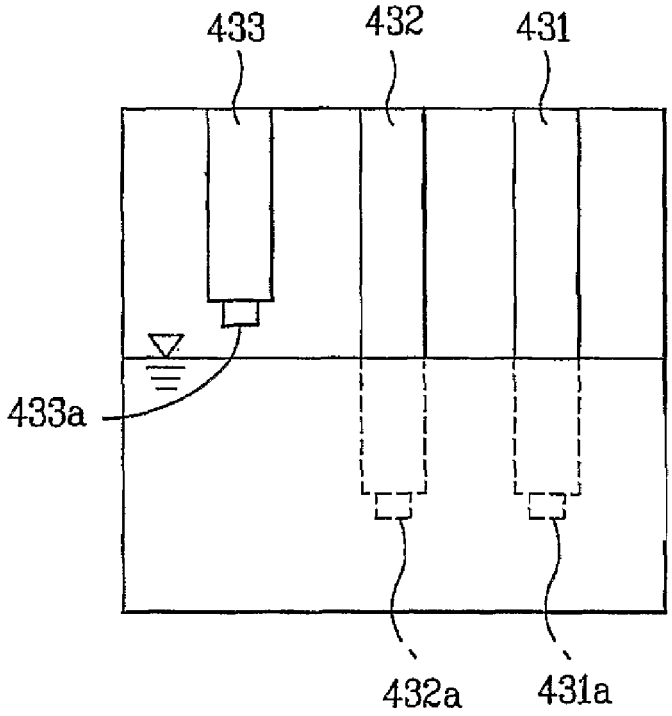

[Fig. 7]
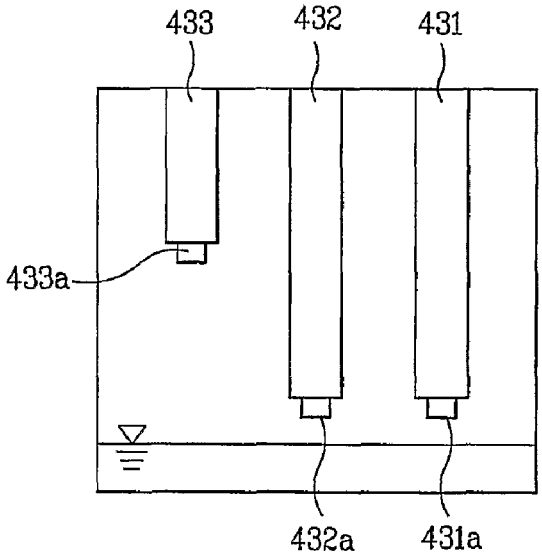
[Fig. 8]
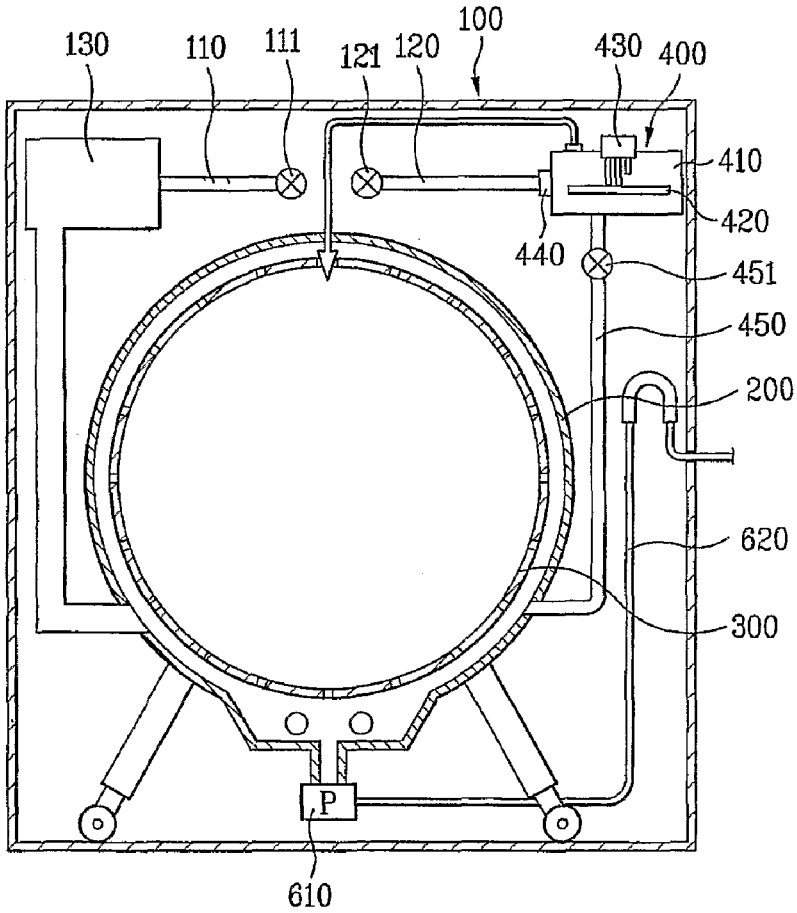

[Fig. 9]
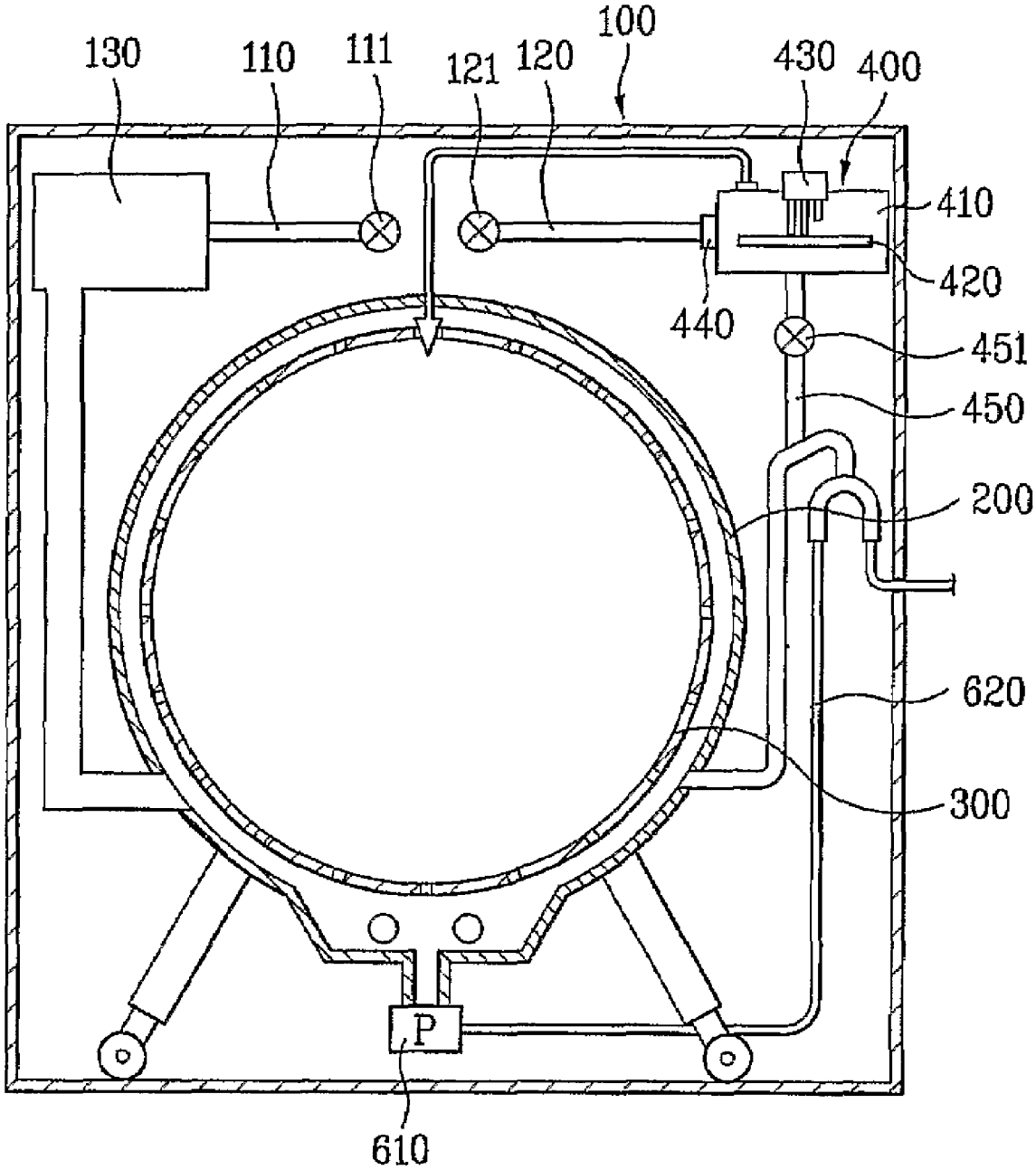

LAUNDRY MACHINE AND A METHOD FOR OPERATING THE SAME

TECHNICAL FIELD

This application claims priority to International application No. PCT/KR2006/001959 filed on May 24, 2006, and Korean Application No. 10-2005-0078195 filed on Aug. 25, 2005, all of which are incorporated by reference, as if fully set forth herein.

The present invention relates to a washing machine, and more particularly, to a structure of a washing machine having a steam generator, which drains remaining steam water, and a method for controlling the same.

BACKGROUND ART

Generally, washing machines include a pulsator washing machine, a drum of which is vertically erected, a drum washing machine, a drum of which is horizontally laid, a washing machine having laundry washing and drying functions, and a drying machine having only a laundry drying machine.

The pulsator washing machine, the drum washing machine, and the washing machine having laundry washing and drying functions perform a washing operation using washing water.

Since a large amount of the washing water is required in the washing operation, an attempt for minimizing the amount of the washing water used has been developed.

For this reason, a steam generator is proposed. The steam generator serves to allow the washing operation to be performed using a small amount of washing water.

After the above conventional steam generator stores water supplied from a water pipe through a separate duct, a heater of the steam generator is operated only when steam supply is required.

The steam generated from the steam generator by the operation of the heater is supplied to a drum.

When the above-described steam generator is not used for a long period time, the water retained in the steam generator is stagnant or a lime component contained in the water is accumulated on the inner wall of the steam generator.

Particularly, the heater and a water level sensor are provided in the steam generator.

Accordingly, the lime component is accumulated on the surface of the heater or a power supply part for supplying power to the heater due to the water retained in the steam generator, thereby causing malfunction of the heater.

Further, the lime component is accumulated on terminals of the water level sensor due to the water retained in the steam generator, thereby causing malfunction of the water level sensor. The malfunction of the water level sensor causes the heater to be excessively operated, thus causing a danger of fire.

DISCLOSURE OF INVENTION

Technical Problem

An object of the present invention devised to solve the problem lies on a washing machine having a novel structure, which prevents water from being retained in a steam generator, and a method for controlling the same.

Technical Solution

The object of the present invention can be achieved by providing a washing machine comprising a steam generator including a case forming a space for storing water to generate steam, and a drain pipe connected to the case for draining the stored water; a valve installed on the drain pipe; and a controller for controlling the steam generator and the valve.

The drain pipe may be connected to a drain pump for draining washing water in a tub, or a drain hose connected to the drain pump.

Further, the drain pipe may be connected to a tub.

In case that the water stored in the case is drained, the controller controls the valve so that the valve is opened.

In another aspect of the present invention, provided herein is a method for controlling a washing machine comprising supplying steam, generated from a steam generator, to a drum; and draining water, stored in the steam generator, through a drain pipe.

Preferably, the drain of the water is performed after the supply of the steam. Thereby, when the steam generator is not used, water does not exist in the steam generator.

Further, the drain of the water may be performed before the supply of the steam. For example, the water existing in the steam generator is drained before the supply of the steam, and clean water is re-supplied to the steam generator. Further, if necessary, in order to adjust the amount of the water in the steam generator, the drain of the water may be performed.

Preferably, the drain of the water is performed while or before one operation, out of a draining operation for draining washing water in a tub, a washing operation for washing laundry, and a rinsing operation for rinsing the laundry, is performed. Thereby, the water in the steam generator is drained together with the drain of the washing water in the tub.

Further, preferably, the drain of the water comprises supplying water to the steam generator, and draining the water in the steam generator.

The supply of the water to the steam generator and the drain of the water in the steam generator may be alternately repeated, or simultaneously performed. The inside of the steam generator is washed through the supply of the water to the steam generator and the drain of the water in the steam generator.

The order of the supply of the water to the steam generator and the drain of the water in the steam generator may be determined according to a water level in the steam generator. Preferably, in case that the water level is higher than a predetermined water level, the drain of the water in the steam generator, the supply of new water to the steam generator, and the drain of the water in the steam generator are sequentially performed. Further, preferably, in case that the water level is lower than a predetermined water level, the supply of new water to the steam generator and the drain of the water in the steam generator are sequentially performed.

Preferably, a water level sensor senses the water level during the drain of the water in the steam generator, and in case that it is determined that the water level is not changed, the drain of the water in the steam generator is terminated.

Advantageous Effects

The washing machines and the methods for controlling the same in accordance with embodiments of the present invention exhibit various effects, as follows.

First, the washing machines and the methods for controlling the same of the embodiments allow steam water, remaining in the steam generator, to be drained, thereby preventing the contamination of the inside of the steam generator and the damage to a heater part due to the remaining steam water.

Second, the washing machines and the methods for controlling the same of the embodiments cause a process for draining the steam water in the steam generator to be performed by repeating the drain of the steam water and the re-supply of the steam water, thereby further preventing the contamination of the inside of the steam generator and the damage to the heater part due to the remaining steam water.

Third, the washing machine and the method for controlling the same of the second embodiment allow the steam water, drained from the steam generator, to be supplied to the inside of the tub and be reused to wash and rinse laundry, thereby minimizing the amount of unnecessary water consumption.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 1 is a longitudinal sectional view of a washing machine in accordance with a first embodiment of the present invention;

FIG. 2 is a transversal sectional view of the washing machine in accordance with the first embodiment of the present invention;

FIG. 3 is an exploded perspective view of a steam generator of the washing machine in accordance with the first embodiment of the present invention;

FIG. 4 is a flow chart for illustrating a method for controlling the washing machine in accordance with the first embodiment of the present invention;

FIGS. 5 to 7 are schematic views illustrating states of a water level for determining the order of a process for draining water in the steam generator in the method for controlling the washing machine in accordance with the first embodiment of the present invention;

FIG. 8 is a longitudinal sectional view of a washing machine in accordance with a second embodiment of the present invention; and FIG. 9 is a longitudinal sectional view of a washing machine in accordance with a modification of the second embodiment of the present invention, for illustrating a connection structure of a drain part.

BEST MODE FOR CARRYING OUT THE INVENTION

Reference will now be made in detail to the preferred embodiments of the present invention, examples of which are illustrated in the accompanying drawings.

As shown in FIGS. 1 and 2, a washing machine in accordance with a first embodiment of the present invention comprises a main body 100, a tub 200, a drum 300, a steam generator 400, and a controller (not shown).

The washing machine of the first embodiment is a drum washing machine. More specifically, the washing machine of the first embodiment may be a general drum washing machine having laundry washing and drying functions, or a drying machine having only a laundry drying function.

The main body 100 forms the external appearance of the washing machine.

A first water supply channel 110 for guiding water (hereinafter, referred to as "washing water") supplied from a water pipe to the inside of the tub 200 and a second water supply channel 120 for guiding water (hereinafter, referred to as "steam water") supplied from the water pipe to the inside of the steam generator 400 are installed in the main body 100.

A first water supply valve 111 is provided on the first water supply channel 110, and a second water supply valve 121 is provided on the second water supply channel 120. The first and second water supply valves 111 and 121 selectively open and close the first and second water supply channels 110 and 120, respectively.

Preferably, the first water supply channel 110 is installed in such a manner that the washing water passes through a detergent box 130 and is supplied to the inside of the tub 200.

The tub 200 is provided in the main body 100, and the drum 300 is rotatably installed in the tub 200.

The steam generator 400 is installed in a space in the main body 100, and serves to evaporate the steam water supplied through the second water supply channel 120 to generate steam.

Preferably, the steam generator 400, as shown in FIG. 3, comprises a case 410, a heater part 420, a water level sensor 430, a water supply part 440 and a drain part 450, and a steam discharge part 460.

Preferably, the case 410 has a box shape for defining the external appearance of the steam generator 400 and forming a steam generating space.

The heater part 420 is provided in the case 410, and serves to evaporate the steam water stored in the case 410. Preferably, a sheath heater is used as the heater part 420.

The water level sensor 430 includes a common electrode 431, a long electrode 432, and a short electrode 433, and serves to sense the level of the steam water in the case 410.

Preferably, the common electrode 431 and the long electrode 432 are installed in such a manner that terminals 431*a* and 432*a* thereof are exposed at a height corresponding to the minimum level of the steam water required to generate steam, and the short electrode 433 having a shorter length than those of the common electrode 431 and the long electrode 432 is installed in such a manner that a terminal 433*a* thereof is exposed at a height corresponding the maximum level of the steam water required to generate the steam.

Further, preferably, the height, at which the terminals 431*a* and 432*a* of the common electrode 431 and the long electrode 432 are exposed, corresponds to the level of the steam water, in which the heater part 420 is completely immersed.

The water supply part 440 is a duct, which guides the steam water, flowing in the second water supply channel 120, to the inside of the case 410.

The drain part 450 is a duct, which is provided with one end connected to the case 410 and discharges the steam water, existing in the case 410, to the outside.

Preferably, the drain part 450 is connected to the bottom surface of the case 410.

Particularly, a drain opening/closing part 451 is provided on the drain part 450. Preferably, an electric valve, the operation of which is electrically controlled, is used as the drain opening/closing part 451.

The steam discharge part 460 is a duct, which guides the steam, generated in the case 410, to the inside of the drum 300 or the tub 200.

The controller is provided in the main body 100, and controls operations of various driving parts of the washing machine.

Further, the controller controls operations of the heater part 420 and the drain opening/closing part 451.

The controller includes an analog-digital converter (ADC) for converting values sensed by the water level sensor 430 of the steam generator 400 into digital data. The controller compares the digital data (hereinafter, referred to as "converted values", which are converted by the ADC, With a predetermined reference value, and controls the operations of the water supply valves 111 and 121 and the operation of the heater part 420 according to the comparison results.

Preferably, the washing machine of the first embodiment further comprises a drain pump 610 and a drain hose 620.

The drain pump 610 is provided in the bottom portion of the main body 100, and pumps the washing water in the tub 200. The drain hose 620 discharges the washing water, pumped by the drain pump 620, to the outside of the main body 100.

In this embodiment, the drain part 450 is connected to the drain hose 620. However, although not shown in the drawings, the drain part 450 may be directly connected to the drain pump 610.

Hereinafter, with reference to FIG. 4 and FIGS. 5 to 7, a method for controlling the washing machine of the first embodiment will be described in detail.

First, the controller receives an operating course, which is selected from various operating courses and inputted by a user (S110).

Then, the controller determines whether or not the inputted operating course requires steam (S120).

The operating course requiring steam includes at least one selected from the group consisting of a steam washing operation, a steam rinsing operation, a steam sterilizing operation, and a steam soaking operation.

When it is determined that the inputted operating course includes the operation not requiring the steam, the corresponding operation is performed without the supply of the steam (S130).

On the other hand, when it is determined that the inputted operating course includes the operation requiring the steam, the controller controls the second water supply valve 121 so that steam water is supplied to the case 410 of the steam generator 400 through the second water supply channel 120 (S140).

At this time, the steam water is continuously supplied to the case 410 until it is determined that the supply of the steam water is completed. Whether or not the supply of the steam water is completed is determined based on the data sensed by the water level sensor 430.

Now, the determination of the completion of the supply of the steam water will be described in more detail.

First, the water level sensor 430 senses the level of the steam water supplied to the inside of the case 410, and the controller receives the above values, sensed by the water level sensor 430, from the water level sensor 430.

Here, the sensed values refer to voltage values of the long electrode 432 and the short electrode 433.

The controller converts the voltage values of the long electrode 432 and the short electrode 433 into digital data using the ADC, and then confirms the converted values.

The controller compares the converted values with the predetermined reference value.

For example, in case that the reference value is 150, the controller determines whether or not the converted values of the voltages values of the long electrode 432 and the short electrode 433 are higher or lower than or equal to 150.

When at least one of the converted values of the voltage values of the long and short electrodes 432 and 433 is higher than 150, the supply of the steam water is continuously performed, and when both the converted values of the voltage values of the long and short electrodes 432 and 433 are lower than 150, the controller controls the second water supply valve 121 so that the supply of the steam water is stopped (S150).

The controller controls the heater part 420 so that the heater part 420 is operated to generate steam (S160), and the generated steam is supplied to the inside of the drum 300 through the steam discharge part 460 (S170).

The heater part 420 is continuously operated until the temperature in the drum 300 reaches a predetermined temperature due to the steam. When the temperature in the drum 300 reaches the predetermined temperature, the operation of the heater part 420 is stopped.

Hereinafter, the corresponding operation using the steam (for example, the steam washing operation, the steam rinsing operation, the steam sterilizing operation, or the steam soaking operation) is performed.

When the operation using the steam is completed, the steam water remaining in the steam generator 400 is completely drained (S180).

Here, the controller controls the drain opening/closing part 451 so that the drain part 450 is opened, thereby draining the steam water.

That is, when the drain part 450 is opened, the steam water in the case 410 is drained through the drain part 450, and is then drained to the outside of the main body 100 through the drain hose 620.

Preferably, the drain of the steam water is performed before a drain operation for draining washing water in the tub 200 is performed or during the drain operation.

Since the drain pump 610 is operated when the drain operation is performed, the washing water or the steam water in the drain hose 620 can be completely drained.

More preferably, the process for draining the steam water is not performed simply by a process for opening only the drain part 450, but is performed by repeating the drain of the steam water and the re-supply of the steam water at least once.

The repetition of the drain of the steam water and the re-supply of the steam water serves to wash the inner wall of the case 410.

That is, the steam water heated by the heater part 420 contains a large amount of a lime component, and although the process for draining the steam water is performed, a small amount of the steam water may remain on the inner wall or the bottom surface of the case 410. The remaining steam water causes corrosion of the inner wall or the bottom surface of the case 410 or corrosion of the surface of the heater part 420. Accordingly, the heated steam water must be completely drained, thereby minimizing the above problem (the corrosion of the inner wall or the bottom surface of the case or the corrosion of the surface of the heater part).

Preferably, the order of the drain of the steam water and the re-supply of the steam water is determined differently according to the water level in the case 410 of the steam generator 400.

That is, as shown in FIGS. 5 and 6, when the water level in the case 410 is higher than the predetermined water level, the steam water in the case 410 is drained, new steam water is re-supplied to the inside of the case 410, and the re-supplied steam water in the case 410 is drained.

On the other hand, as shown in FIG. 7, when the water level in the case 410 is lower than the predetermined water level, new steam water is re-supplied to the inside of the case 410, and the re-supplied steam water in the case 410 is drained.

The confirmation of the water level is performed by sensing the voltage values of the long electrode 432 and the short electrode 433 of the water level sensor 430, converting the sensed voltage values into digital data using the ADC, and comparing the converted values with the predetermined reference value (for example, 150).

During the process for draining the steam water in the method for controlling the washing machine in accordance with the first embodiment of the present invention, in case that it is determined that the water level is not changed after a predetermined time has elapsed, the process for draining the steam water is terminated.

That is, after the predetermined time (for example, 1 minute) has elapsed from the opening of the drain opening/closing part 451, the voltage values of the long electrode 432 and the short electrode 433 are continuously sensed by the water level sensor 430, and the sensed voltage values of the long electrode 432 and the short electrode 433 are converted into digital data by the ADC. Thereafter, the converted values are continuously confirmed, and when the converted values are not changed, the process for draining the corresponding steam water is terminated.

Here, the process for draining the steam water is terminated by closing the drain part 450 by means of the operation of the drain opening/closing part 451.

MODE FOR THE INVENTION

FIG. 8 illustrates a washing machine in accordance with a second embodiment of the present invention.

That is, in the washing machine of the second embodiment, the drain part 450 discharges steam water to the inside of the tub 200.

Since the drain part 450 is directly connected to the tub 200.

On the other hand, as shown in FIG. 9, the drain part 450 may be connected to a channel guiding washing water to the tub 200, among channels of the washing water, which is pumped by the drain pump 610 and flows towards the drain hose 620 and the tub 200.

The above structure of the washing machine of the second embodiment does not drain the steam water in the steam generator 400 directly to the outside, but supplies the steam water in the steam generator 400 to the inside of the tub 200 so that the steam water is used in the washing operation or the rinsing operation.

That is, the washing machine of the second embodiment uses a small amount of the steam water to wash or rinse the laundry, thereby reducing the amount of water consumption.

Hereinafter, a method for controlling the washing machine of the second embodiment will be described.

First, a process for performing an operation using steam is the same as that in the first embodiment.

Thereafter, when the operation using the steam is terminated, the controller determines whether or not a predetermined time comes.

Here, the predetermined time refers to a time while or before one operation out of a draining operation for draining washing water in the tub (or the drum), a washing operation for washing laundry, and a rinsing operation for rinsing the laundry, is performed.

Since the rinsing operation is repeated at least twice, the steam water is drained before at least one rinsing operation is performed.

In the second embodiment, the predetermined time is a time when washing water, for performing the final rinsing operation, is supplied.

That is, when the washing water for performing the final rinsing operation is supplied, the controller controls the drain opening/closing part 451 so that the drain part 450 is opened, thereby causing the steam water remaining in the case 410 to be supplied to the inside of the tub 200.

More preferably, the process for draining the steam water is performed by repeating the drain of the steam water and the re-supply of the steam water at least once.

As described above, the repetition of the drain of the steam water and the re-supply of the steam water serves to wash the inner wall of the case 410.

Preferably, the order of the drain of the steam water and the re-supply of the steam water is determined differently according to the water level in the case 410 of the steam generator 400.

That is, when the water level in the case 410 is higher than the predetermined water level, the steam water in the case 410 is drained, new steam water is re-supplied to the inside of the case 410, and the re-supplied steam water in the case 410 is drained.

On the other hand, when the water level in the case 410 is lower than the predetermined water level, new steam water is re-supplied to the inside of the case 410 and the re-supplied steam water in the case 410 is drained.

During the process for draining the steam water, the controller confirms whether or not the water level is changed after a predetermined time has elapsed, and in case that it is determined that the water level is not changed, terminates the process for draining the steam water.

That is, after the predetermined time (for example, 1 minute) has elapsed from the opening of the drain opening/closing part 451, the voltage values of the long electrode 432 and the short electrode 433 are continuously sensed by the water level sensor 430, and the sensed voltage values of the long electrode 432 and the short electrode 433 are converted into digital data by the ADC. Thereafter, the converted values are continuously confirmed, and when the converted values are not changed, the process for draining the steam water is terminated by closing the drain part 450 using the drain opening/closing part 451.

After the above process for draining the steam water is terminated, when the level of washing water in the tub 200 reaches a water level for performing the rinsing operation, the final rinsing operation is performed.

The drain part 450 of the washing machine of the present invention need not be connected to one of the drain hose 620 or the drain pump 610, or the tub 200.

That is, although not shown in the drawings, the drain part 450 may be connected simultaneously to the drain hose 620 and the tub 200 or the drain pump 610 and the tub 200.

This structure causes the steam water, if necessary, to be discharged to the drain hose 620 or the drain pump 610, or to the tub 200.

INDUSTRIAL APPLICABILITY

The present invention provides a washing machine, and more particularly a structure of a washing machine having a steam generator, which drains remaining steam water, and a method for controlling the same.

The washing machines and the methods for controlling the same in accordance with the above-described embodiments of the present invention exhibit various effects, as follows.

First, the washing machines and the methods for controlling the same of the embodiments allow steam water, remaining in the steam generator, to be drained, thereby preventing the contamination of the inside of the steam generator and the damage to a heater part due to the remaining steam water.

Second, the washing machines and the methods for controlling the same of the embodiments cause a process for draining the steam water in the steam generator to be performed by repeating the drain of the steam water and the re-supply of the steam water, thereby further preventing the contamination of the inside of the steam generator and the damage to the heater part due to the remaining steam water.

Third, the washing machine and the method for controlling the same of the second embodiment allow the steam water, drained from the steam generator, to be supplied to the inside of the tub and be reused to wash and rinse laundry, thereby minimizing the amount of unnecessary water consumption.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A method for controlling a washing machine comprising steps of:

supplying water to a steam generator;

supplying steam, during an operation using steam, generated from the steam generator, to a drum of the washing machine; and draining water, from the steam generator after the operation using the steam is completed, through a drain pipe, wherein the step of draining water comprises resupplying water to the steam generator and draining the resupplied water mixed with water remaining in the steam generator after the operation using steam was completed from the steam generator, and wherein the draining is performed before or during a drain operation for draining washing water from a tub is performed.

2. The method according to claim 1, wherein the step of resupplying water to the steam generator and the step of draining the resupplied water mixed with water remaining in the steam generator are alternately repeated, or simultaneously performed.

3. The method according to claim 1, wherein the performing order between the steps of resupplying the water to the steam generator and draining the resupplied water mixed with water remaining in the steam generator is determined according to a water level in the steam generator.

4. The method as set forth in claim 3, wherein, in case that the water level is higher than a predetermined water level, the step of draining the resupplied water mixed with water remaining in the steam generator, the step of resupplying water to the steam generator, and the step of draining the resupplied water mixed with water remaining in the steam generator are sequentially performed.

5. The method as set forth in claim 3, wherein, in case that the water level is lower than a predetermined water level, the step of resupplying water to the steam generator and the step of draining the resupplied water mixed with water remaining in the steam generator are sequentially performed.

6. The method as set forth in claim 3, wherein a water level sensor senses the water level during the step of draining the resupplied water mixed with water remaining in the steam generator, and in case that it is determined that the water level is not changed, the step of draining the resupplied water mixed with water remaining in the steam generator is terminated.

7. A method for controlling a washing machine comprising steps of:

supplying water to a steam generator;

supplying steam, generated at the steam generator, to a drum of the washing machine;

sensing a water level of water remaining in the steam generator after the supplying steam step; and draining the water remaining in the steam generator after the sensing step through a drain pipe, wherein the step of draining water remaining in the steam generator comprises resupplying water to the steam generator and draining the resupplied water mixed with water remaining in the steam generator from the steam generator, wherein a performing order, between the steps of resupplying the water to the steam generator and draining the resupplied water mixed with water remaining in the steam generator, is determined according to the sensed water level in the steam generator, and wherein the draining is performed before or during a drain operation for draining washing water from a tub is performed.

8. The method according to claim 7, wherein the step of resupplying water to the steam generator and the step of draining the resupplied water mixed with water remaining in the steam generator are alternately repeated, or simultaneously performed.

9. The method as set forth in claim 7, wherein, in case that the water level is higher than a predetermined water level, the step of draining the resupplied water mixed with water remaining in the steam generator, the step of resupplying water to the steam generator, and the step of draining the resupplied water mixed with water remaining in the steam generator are sequentially performed.

10. The method as set forth in claim 7, wherein, in case that the water level is lower than a predetermined water level, the step of resupplying water to the steam generator and the step of draining the resupplied water mixed with water remaining in the steam generator are sequentially performed.

11. The method as set forth in claim 7, further comprising sensing the water level during the step of draining the water remaining in the steam generator, and in case that it is determined that the water level is not changed, the step of draining the water remaining in the steam generator is terminated.

* * * * *